US005219312A

United States Patent [19]

Smith

[11] Patent Number: 5,219,312

[45] Date of Patent: Jun. 15, 1993

[54] VENTILATORS

[75] Inventor: Nigel R. Smith, Colchester, England

[73] Assignee: Titon Hardware Limited, Colchester, England

[21] Appl. No.: 781,345

[22] Filed: Oct. 25, 1991

[30] Foreign Application Priority Data

Oct. 25, 1990 [GB] United Kingdom ..... 9023311

[51] Int. Cl.[5] ..... E06B 7/02; F24F 13/24

[52] U.S. Cl. ..... 454/213; 454/906

[58] Field of Search ..... 454/206, 213, 226, 271, 454/276, 277, 281, 282, 367, 906

[56] References Cited

U.S. PATENT DOCUMENTS

| | | | |
|---|---|---|---|
| 1,929,595 | 10/1933 | Macleod | 454/906 X |
| 1,938,798 | 12/1933 | Bourne | 454/206 |
| 2,202,339 | 5/1940 | Dresser et al. | 454/213 |
| 3,255,688 | 6/1966 | Iwata | 454/213 |
| 4,953,451 | 9/1990 | Arbouw | 454/213 X |

FOREIGN PATENT DOCUMENTS

| | | | |
|---|---|---|---|
| 112630 | 7/1982 | Japan | 454/206 |

*Primary Examiner*—Harold Joyce

*Attorney, Agent, or Firm*—Millen, White, Zelano & Branigan

[57] ABSTRACT

A slot ventilator having a canopy with a downwardly facing air inlet and a rear wall having an air outlet which, in use, leads to the slot with which the ventilator is associated includes at least one longitudinally extending baffle which increases the flow path between the inlet face and the outlet, at least one surface of the baffle being formed with corrugations which reduce noise generated by air flowing through the ventilator. The ventilator comprises a profile member affording upper and front walls of the canopy and at least one insert slidable longitudinally into the profile member and affording the baffle or baffles. Preferably, the ventilator includes at least two of the said inserts, one being longer than the other.

10 Claims, 3 Drawing Sheets

VENTILATORS

BACKGROUND OF THE INVENTION

This invention relates to ventilators, more particularly but not exclusively for use in rooms with sealed windows and/or double glazing where it is desirable to provide for ventilation without having to, open the window. This type of ventilation is now often referred to as "secondary ventilation" and has in recent years been achieved by means of a slot ventilator which is inserted into or positioned over a slot cut or formed in the surround of a window or the like. It is usual to provide at the inside end of the slot a manually operable ventilator closure or a grille while at the outside end it is usual to provide a canopy forming a lip extending outwardly and downwardly from the upper edge of the slot to resist the ingress through the slot of rain and other precipitation and to discourage the entry of dust and dirt and insects.

The present invention has as at its object to improve such canopies.

SUMMARY OF THE INVENTION

According to the present invention the canopy includes at least one longitudinally extending baffle which increases the flow path between the downwardly open lower face of the canopy and the rear wall of the canopy which, in use, leads to the slot adjacent to which the canopy is located, at least one surface of the baffle being formed with corrugations. Preferably the baffle itself is corrugated so that corrugations appear on both surfaces of the baffle. Although the crest lines and valley lines of the corrugations may be linear or non linear and may extend parallel to the length of the baffle or perpendicular thereto or at any inclination thereto, in the preferred arrangement the crest lines and valley lines are straight or linear and extend perpendicular to the length of the baffle. In a preferred arrangement the canopy includes a baffle having one longitudinal edge which is at or adjacent to the rear face of the canopy so that it will, in use, be adjacent to or in contact with the partition, window frame or the like in which the slot is formed and extends in a direction which is inclined upwardly and forwardly from this edge to the other edge which is a free edge spaced from the front wall of the canopy. The canopy may include a corrugated baffle (which may be the only baffle or in addition to the previously described baffle) extending from the front wall of the canopy rearwardly and downwardly to a free edge at or adjacent the bottom of the canopy to close off part of the bottom of the canopy.

Preferably, the ventilator comprises a profile member affording upper and front walls of the canopy, and at least one insert slidable longitudinally into the profile member and affording the baffle or baffles. There may be separate end caps closing the ends of the profile member and these end caps may retain the insert or inserts in place within the profile member. By constructing the ventilator of a profile member and at least one baffle-affording insert it is possible easily to provide ventilators of different lengths from a small number of basic components. For example, there may be profile members of several different lengths and two forms of baffle-affording insert, one short and one long, and a ventilator of desired length can be built up of a profile member of appropriate length and the appropriate combination of short and/or long inserts. In a preferred construction, the or each insert comprises an integral structure comprising at least two longitudinally extending baffles and transverse connectors spanning between the baffles. In a construction in which there are end caps, there may be a connector at each end of the or each insert with complementary interengaging locating means on the connectors and the end caps.

The invention may be carried into practice in various ways but one ventilator canopy embodying the invention will now be described by way of example with reference to the accompanying drawings.

DESCRIPTION OF THE PREFERRED EMBODIMENT

Figure 1:
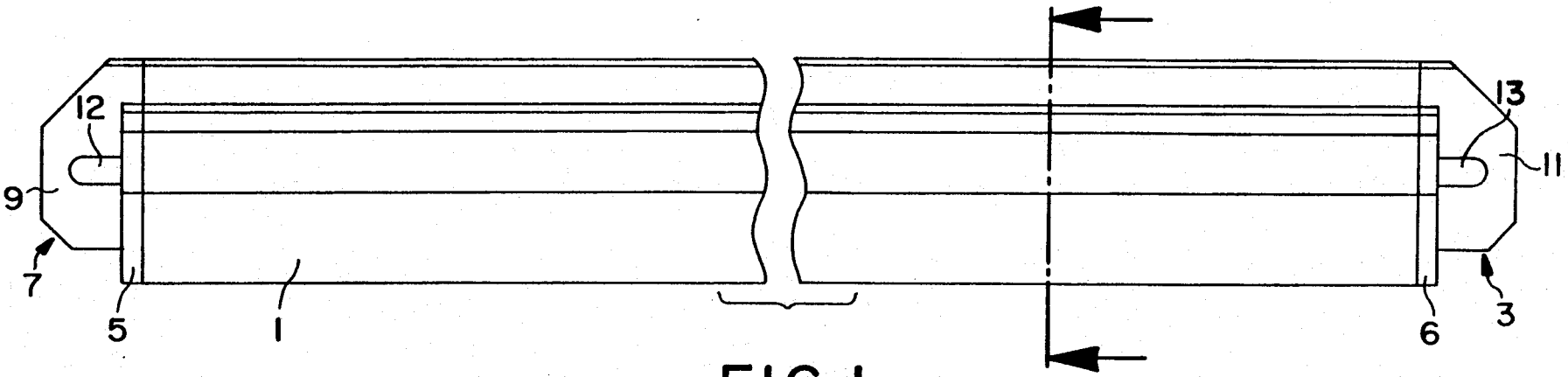
FIG. 1 is a front elevation of the ventilator.
Figure 2:
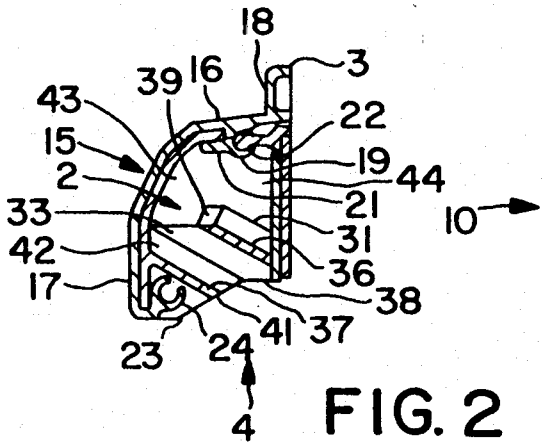
FIG. 2 is a section on line II—II in FIG. 1.
Figure 5:
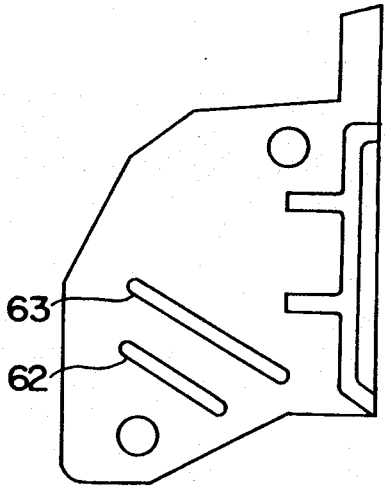
FIG. 5 is a side elevation of the left hand end cap seen from the right in FIG. 1.

The ventilator shown in the drawing is in the form of an elongate canopy which is generally cowl-shaped as can be seen from FIGS. 1 and 2 and comprises a front wall 1 which affords a generally tubular interior 2 which is, when the ventilator is in position for use, bounded to the rear on the plane 3 by a window frame or the like in which is formed a slot through which air is intended to pass and which is protected by the canopy. Thus the space 2 is generally open to the rear to provide an air outlet 10 on the plane 3 and is also generally open downwardly to provide an air inlet 4. The ends of the internal space 2 are bounded by end walls 5,6 provided by end caps 7,8 from which project lugs 9,11 containing holes 12,13 through which screws may be passed to secure the ventilator to the window frame or the like.

The main component of the ventilator is a profile member 15 which is of constant cross section as can be seen from FIG. 2 and affords the top and front walls 16,17 of the canopy together with an upper flange wall 18. On the underside of the upper wall 16 there is a first complex rib 19 having a forwardly directed flange 21 and a rearwardly directed flange 22 the latter forming a part circular recess. On the rear of the front wall 17 there is a continuous rib 23 formed with jaws 24 to provide a part circular recess. The profile member 15, in the embodiment being described, is of aluminum but could for example be of plastics material.

Figure 8:
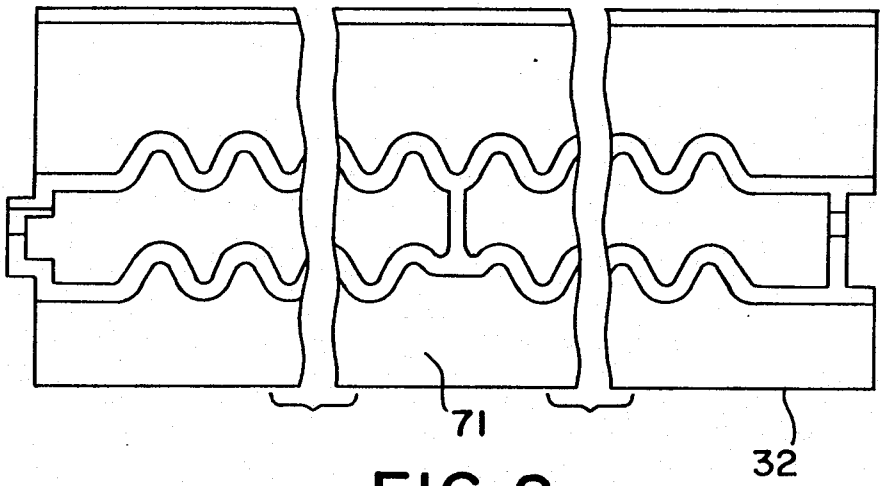
FIG. 8 is a view similar to FIG. 7 of another baffle insert.
Figure 7:
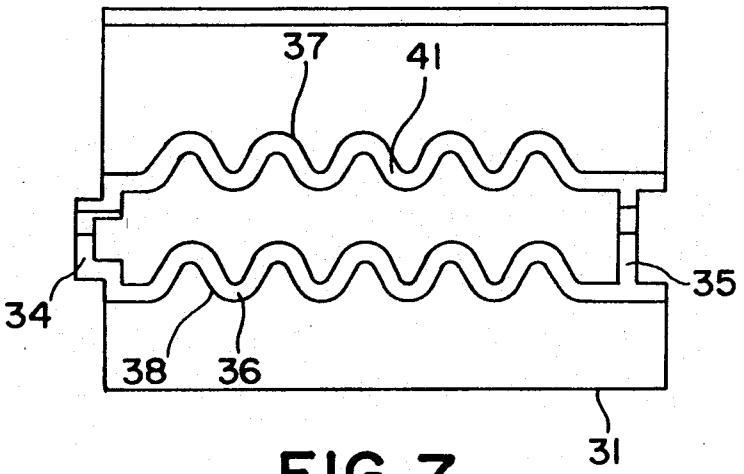
FIG. 7 is an oblique inverted plan view of one of the baffle inserts contained in the ventilator and seen in the direction of the arrow 7 in FIG. 2.

Located within the canopy are baffle inserts 31,32 of the constructions shown in FIGS. 7 and 8. That shown in FIG. 7 is a so-called "short" baffle insert while that shown in FIG. 8 is a so-called "long" baffle insert. The numbers of inserts arranged end to end contained within the profile member 15 will depend upon the length of the profile member which in turn will depend upon the length of ventilator required but typically profile members of lengths between 10 inches and 27.6 inches (256 and 702 mm) may be provided and containing various numbers of short and long inserts from one of each to three of each. The short baffle member 31 shown in FIG. 7 will now be described but it will be appreciated that the long baffle member 32 shown in FIG. 8 is similar.

It can be seen from FIG. 2, which shows a cross section of the baffle member 31, that the baffle member comprises a longitudinal wall 33 which is complimentary to and fits within the top wall 16 and front wall 17 of the profile member 15 and is retained in position by the flange 21 and the rib 23. Extending the length of the baffle member 31 between end walls 34,35 are a first baffle 36 and a second baffle 37. The first baffle 36 has a lower rear edge 38 which is adjacent to the plane 3 so that when the canopy is in use this edge will be close to the window frame or the like to which the canopy is secured. The baffle 36 extends upwardly and forwardly to its opposite free edge 39. The baffle 37 has a lower rear edge 41 from which it extends forwardly and upwardly at an angle of inclination equal to the angle of inclination of the baffle 36 to its forward edge where it merges into the front wall 33 of the baffle member. The baffles 36 and 37 thus provide a passage for the admission of air through the slot in the window frame or the like, this passage extending from the open lower end 4 along an upwardly and forwardly extending portion 42, an upwardly and slightly rearwardly extending portion 43 and a directly rearwardly extending portion 44 leading to the air outlet 10 and hence to the slot. Each of the baffles is corrugated as can be seen from FIG. 7, the lines of the crests and valleys of the corrugations extending transverse to the lengths of the baffles and hence to the length of the canopy. Because these baffles are corrugated they present a substantial surface area to the air flowing through the canopy and provide extended surfaces for the absorption of sound, the canopy thus acting as a sound attenuator.

Figure 9:
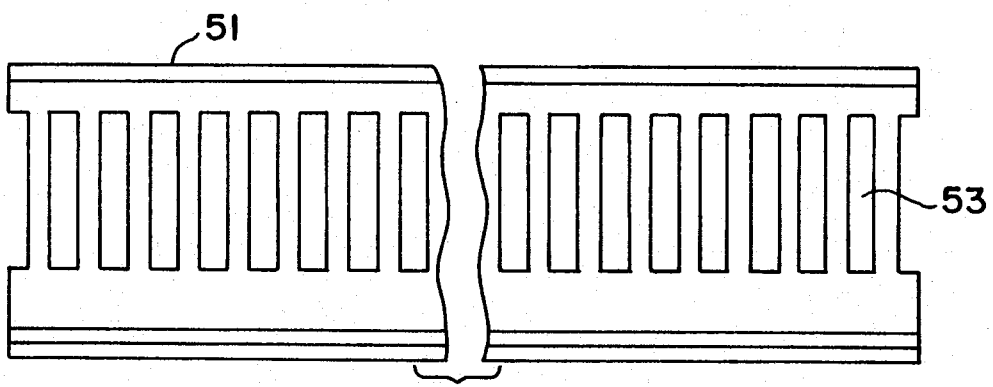
FIG. 9 is a rear elevation of the rear grill of the ventilator.
Figure 10:
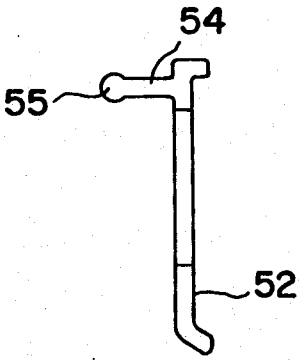
FIG. 10 is an end elevation of the grill shown in FIG. 9.

Between the rearwardly directed passage 44 and the air outlet 10 leading to the slot in the window frame there is a grill 51 which, as can be seen from FIGS. 9 and 10, comprises a generally vertical wall 52 containing rectangular apertures 53 and a horizontally extending upper flange 54 ending in a bulb 55 which is received in the part-circular recess afforded by the rear flange 22.

Figure 6:
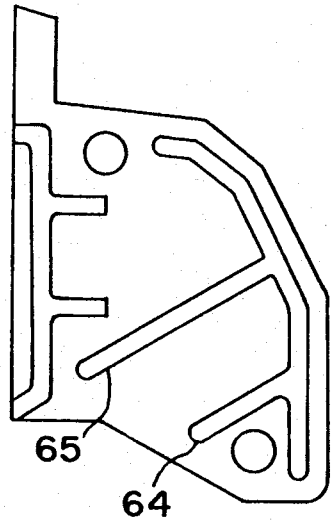
FIG. 6 is an end elevation of the right hand end cap seen from the left in FIG. 1.
Figure 4:
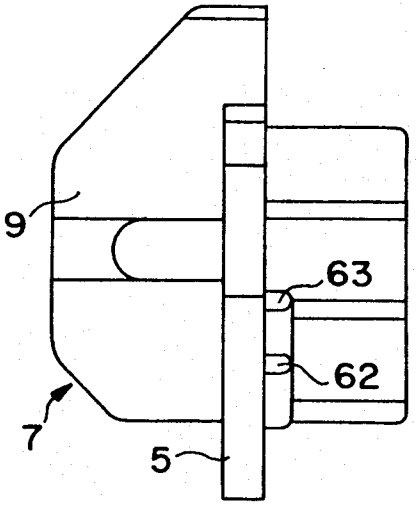
FIG. 4 is a front elevation of the left hand end cap of the ventilator.
Figure 3:
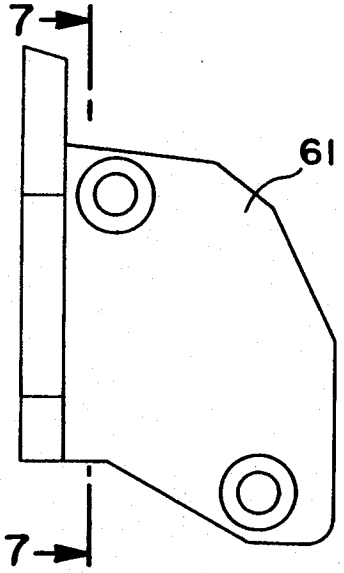
FIG. 3 is an end elevation to a larger scale of the ventilator shown from the left in FIG. 1.

Reverting now to FIGS. 3 to 6, it will be seen that the left hand end cap comprises an end wall 61 from which, on one side, the lug containing the screw hole extends and from the other, inner side two parallel inclined flanges 62 and 63 extend. It can be seen from FIG. 7 that the end wall 34 of the baffle member 31 extends a short distance to the left beyond the baffles themselves and this provides a spigot which is received between the two flanges 62,63 to locate the baffle member 31 within the end cap. At the opposite end of the baffle member 31 the baffle walls 36,37 extend beyond the end wall 35 to afford a socket which cooperates with a pair of flanges 64,65 formed on the inner wall of the right hand end cap as can be seen in FIG. 6.

The long baffle member 32 shown in FIG. 8 is similar to the short baffle member shown in FIG. 7 but includes a central connecting wall 71 to provide stiffness to the baffle walls. It will be appreciated that the spigots formed at the left hand ends of the baffle inserts 31 and 32 fit the sockets formed at the right hand ends of similar baffle members so that any desired number of baffle members can be positioned end to end with the spigots and sockets engaging one another.

I claim:

1. A slot ventilator having a canopy with a downwardly facing inlet and a rear wall having an air outlet which, in use, leads to a slot with which the ventilator is associated, the canopy including at least one longitudinally extending baffle which increases the flow path between the inlet and the rear wall, at least one surface of the baffle being formed with corrugations having crest lines extending generally parallel with the local direction of the flow path.

2. A ventilator according to claim 1 in which the baffle itself is corrugated whereby corrugations appear on both surfaces of the baffle.

3. A ventilator according to claim 1 in which the crest lines and valley lines of the corrugations are straight and extend perpendicular to the length of the baffle.

4. A ventilator according to claim 1 in which the canopy includes said baffle having one longitudinal edge which is at or adjacent to the rear face of the canopy and extends in a direction which is inclined upwardly and forwardly from this edge to the other edge which is a free edge spaced from the front wall of the canopy.

5. A ventilator according to claim 4 in which the canopy further includes said corrugated baffle extending from the front wall of the canopy rearwardly and downwardly to a free edge at or adjacent the bottom of the canopy to close off part of the bottom of the canopy.

6. A ventilator according to claim 1 which comprises a profile member affording upper and front walls of the canopy and at least one insert slidable longitudinally into the profile member and affording the baffle.

7. A ventilator according to claim 6 which includes at least two of the said inserts, one being longer than the other.

8. A ventilator according to claim 6 in which the insert comprises an integral structure comprising at least two longitudinally extending baffles and transverse connections spanning between the baffles.

9. A ventilator according to claim 8 which includes separate end caps closing the ends of the profile member and in which there is a connector at each end of the or each insert with complementary interengaging locating means on the connectors and the end caps.

10. A ventilator according to claim 6 which includes separate end caps closing the ends of the profile member.

* * * * *